United States Patent [19]

Hafner

[11] 4,176,441

[45] Dec. 4, 1979

[54] LOCKING JOINT MACHINE

[76] Inventor: Otto P. Hafner, 1321 Paddock Way, Cherry Hill, N.J. 08034

[21] Appl. No.: 866,038

[22] Filed: Dec. 30, 1977

Related U.S. Application Data

[63] Continuation-in-part of Ser. No. 764,470, Jan. 31, 1977.

[51] Int. Cl.[2] ..... B23P 19/00

[52] U.S. Cl. ..... 29/566.1; 29/432.1; 29/521; 29/798; 113/1 N; 113/116 FF

[58] Field of Search ..... 29/432, 432.1, 521, 29/798, 566.1; 72/335, 451; 83/630; 113/1 M, 1 N, 116 FF

[56] References Cited

U.S. PATENT DOCUMENTS 3,900,937 8/1975 Schleicher ..... 29/432 X

*Primary Examiner*—Z. R. Bilinsky

*Attorney, Agent, or Firm*—Weiser, Stapler & Spivak

[57] ABSTRACT

Locking joints in hard-to-reach locations are made by a machine which uses a toggle linkage and a camming means to produce not only the joint-forming movements of a piercing punch, piercing die and flattening punch, but also the additional movements of these tool elements necessary to reach the joint location. No displacement of the over-all machine is necessary.

12 Claims, 4 Drawing Figures

LOCKING JOINT MACHINE

The present application is a continuation-in-part of my prior, co-pending application Ser. No. 764,470, filed Jan. 31, 1977, and is directed to a further ramification and improvement of the technique taught in that prior application.

In particular, the present invention is directed to a new and improved technique for making certain types of joints between juxtaposed layers of material, such as sheet metal, plastic sheeting or other material having somewhat ductile properties, and doing so under particular conditions when physical access to the materials to be joined is somewhat restricted.

As explained in my above-identified prior patent application, the types of joints in question are known, per se.

They are disclosed, for example, in my following prior U.S. Pat. Nos.:

3,726,000, issued Apr. 10, 1973;
3,862,485, issued Jan. 28, 1975;
3,885,299, issued May 27, 1975;
3,924,378, issued Dec. 9, 1975;
3,934,327, issued Jan. 27, 1976;
3,981,064, issued Sept. 21, 1976.

As taught in those prior patents, these joints are formed by partially piercing adjacent portions of the several juxtaposed layers, and then flattening or swaging the pierced portions, or at least the pierced portion of the layer or layers closest to the unpierced portion of the material layers. These swaged portions then tend to overlap the unpierced material and lock the joint securely against separation.

A variety of fastening machines have been devised for carrying out the operations involved in making such joints, as exemplified by the patents referenced above. These machines basically function as follows: the layers to be joined are placed between two jaws of the machine. One jaw holds a piercing die, the other a piercing punch. This die and punch then cooperate to perform the partial piercing operation, displacing the pierced layers of material far enough so that they protrude to at least some degree beyond the portions of material which have remained unpierced. The jaw which holds the die also holds a swaging or flattening punch. Following the piercing, this swaging punch cooperates with the piercing punch to flatten the pierced (displaced) material portion. During this flattening, or at least during some part of the flattening stroke, the die is preferably used to confine laterally some or all of that displaced material layer which is closest to the swaging punch, while leaving unconfined that displaced material layer which is closest to the piercing punch. As a result, the swaging, or flattening effect takes place selectively in the unconfined layer closest to the piercing punch.

Various aspects of this technique were susceptible of further improvements. These included simplification of the overall mechanism, increased flexibility of adaptation to different characteristics of the materials to be joined, improved suitability for the making of multiple joints, and so forth.

Improvements in one or more of these respects are provided by the machines which are the subject of my above-identified prior application Ser. No. 746,470. These improvements particularly feature the uses of inclined plane camming and toggle action.

A remaining matter not specifically addressed in this prior art is that of forming such joints in hard-to-reach locations.

For example, in the manufacture of automobile hoods, or trunk lids it is desirable to use joints such as being discussed to fasten an inner liner to the outer metal layer of the hood or trunk lid.

The outer perimeter of such a hood or trunk lid structure is typically formed with a downturned lip, extending at right angles to the general plane of the structure. In addition, there is typically a second, narrower lip at right angles to the first. The perimeter therefore is in the general shape of a U, open toward the interior of the structure. Moreover, these lips are usually quite close to an inward bulge in the inner liner which, with the lips, defines a rather deep, but narrow channel, again extending along the perimeter of the structure.

The location at which the joints between inner liner an outer layer must be made is precisely in the bottom of the U. The machine for making these joints must therefore be capable of "reaching" into this hard-to-reach location, and then also perform the multiple, coordinated movements which are necessary to produce the desire joints, with the high precision and force which are also required.

Attempts to accomplish all this have not been altogether successful. So far as is known to this applicant, these attempts have involved first moving a fastening machine of this general type into a position in which the rim of the structure was within the open "jaw" of the machine with the die and flattening punch on one side of the rim and the piercing punch on the other side, but with all these tool elements spaced from that rim. The whole fastening machine then had to be shifted until the die came to bear upon the materials to be joined. Only then could the joint-producing relative movements of the tool elements be carried out.

This gave rise to very undesirable machine characteristics. In particular the need to move the whole heavy and bulky fastening machine before each joint formation introduced a whole additional order of complexity.

Accordingly, it is an object of the present invention to provide fastening machines for producing the types of joints under consideration, but particularly adapted for use with objects of complex configurations.

It is another object to provide such fastening machines which are capable of providing such joints in certain hard-to-reach locations.

It is another object to provide such machines which provide such joints at the rims of objects having reentrant configurations.

It is another object to provide such machines which do not require movement of the entire machine assembly.

It is still another object to provide such machines which retain the feature of inclined plane camming.

It is still another object to provide such machines which retain the feature of toggle action.

It is still another object to provide such machines which are of comparatively simple construction.

These and other objects of the invention which will appear are accomplished as follows. A reciprocating toggle linkage is used to impart all the necessary operating movements to the fastening machine. The piercing die and swaging punch are mounted on reciprocable slides so connected to the toggle linkage that both this die and punch can reciprocate together, to vary the over-all opening defined by the machine jaws. The piercing punch is mounted on another slide, so connected to the toggle linkage as to reciprocate this punch toward and away from the swaging punch and piercing die, in the course of performing first the piercing and then the flattening function. Finally, a slidable inclined-plane cam is provided, also actuated by the toggle linkage, to vary the relative positions of piercing die and swaging punch in order to establish first the conditions for piercing and then the conditions for flattening of the materials being joined.

For further details, reference is made to the discussion which follows, in the light of the accompanying drawings wherein.

The same reference numerals are used in the various figures to designate corresponding elements.

Figure 1:
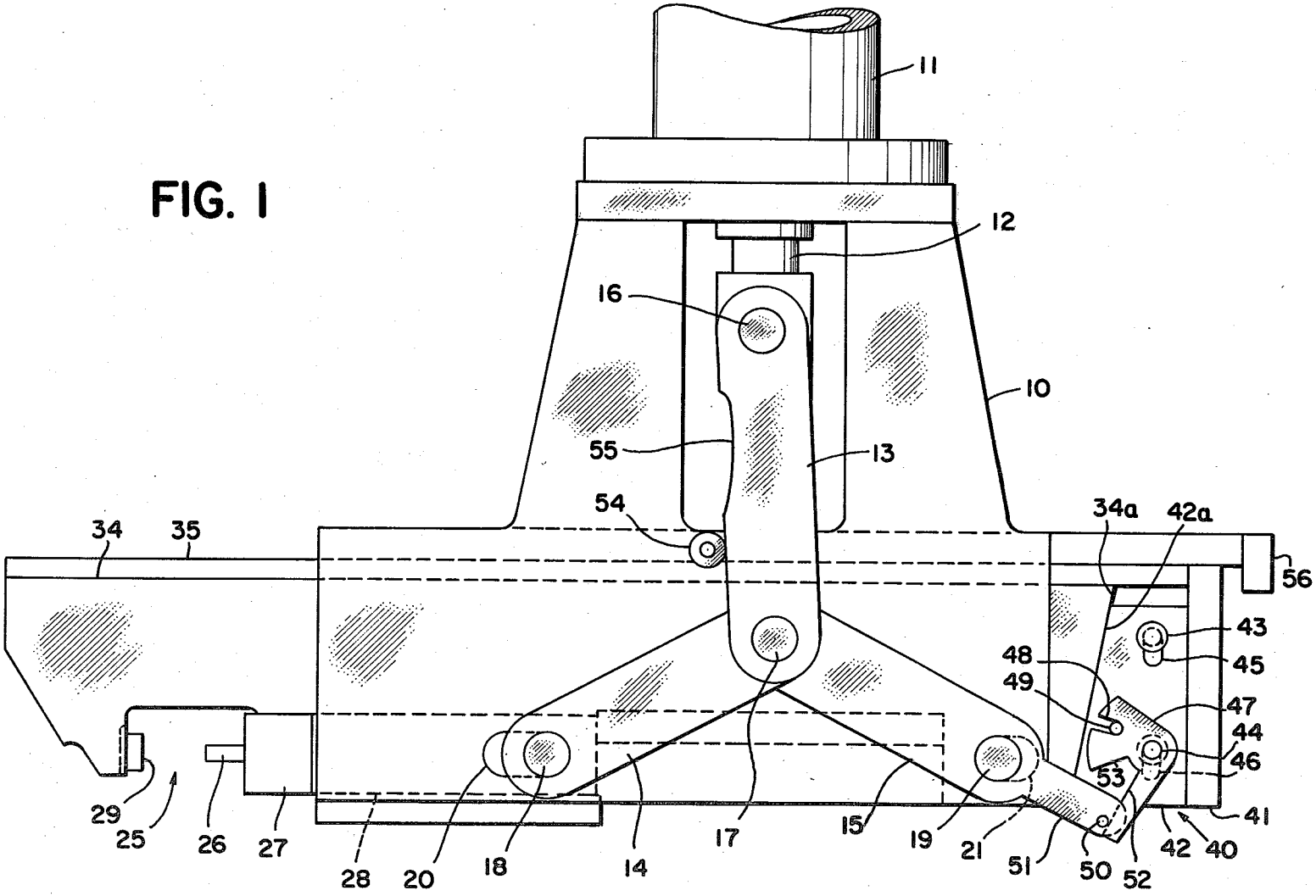
FIG. 1 is a side elevation view of a fastening machine embodying the invention; taken with the jaws in their widest open position.

Referring to the drawings, these show a stationary main frame 10, which supports all of the other elements, and with respect to which any movements of these elements take place. The actuating power for the machine is supplied by a cylinder 11 which imparts reciprocating motion to a piston 12 extending downwardly from cylinder 11. Attached to piston rod 12 is a Y-shaped toggle linkage consisting of elements 13, 14 and 15. For convenience in referring to these three elements of the toggle linkage, they will be referred to hereafter as follows. Element 13 will be spoken of as the "drive link" of the toggle linkage, element 14 as the "jaw link," and element 15 as the "positioning link." As the discussion progresses the reasons for this terminology will appear, although it is desired to emphasize that no restrictive connotation is to be attributed to this terminology.

It will be apparent that up-and-down movement of piston rod 12 in response to actuation by cylinder 11 will cause drive link 13 to also move up-and-down together with a pivoting movement about pin 16. These up-and-down movements of drive link 13 will then "translate" into spreading and folding movements between jaw link 14 and positioning link 15. In so doing, these latter links will pivot about pin 17. Near their ends remote from pin 17, each of links 14 and 15 is provided with another pivot pin, link 14 being so provided with pin 18 and link 15 being so provided with pin 19. These pins 18 and 19 serve to constrain the movements of these remote ends of jaw link 14 and positioning link 15 in a direction generally transverse to the movement of piston rod 12 and drive linkage 13, i.e., in horizontal directions in the drawings. To that end, these pins 18 and 19 are trapped within slots 20 and 21 respectively. However, these pins also permit rotation of these remote ends of jaw link 14 and positioning link 15. By virtue of all of this, it will be seen that, as the piston rod 12 moves downwardly from the position shown in FIG. 1, the angle included between jaw link 14 and positioning link 15 will gradually widen and, as is shown in FIG. 2, will ultimately become 180°, that is the linkage will be in its toggle position.

Figure 2:
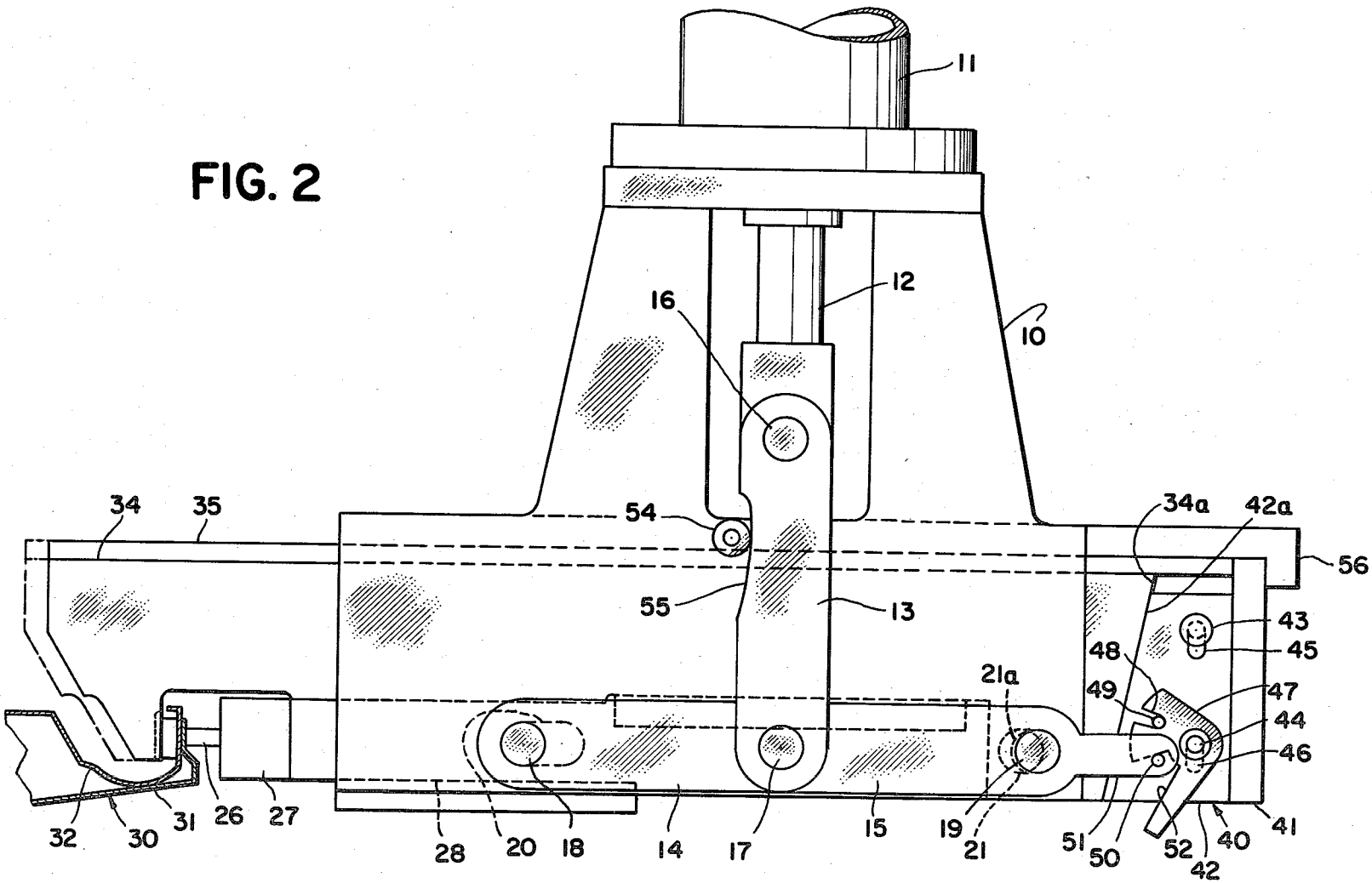
FIG. 2 is a similar view of the machine of FIG. 1, but taken in its piercing position.
Figures 3, 4:
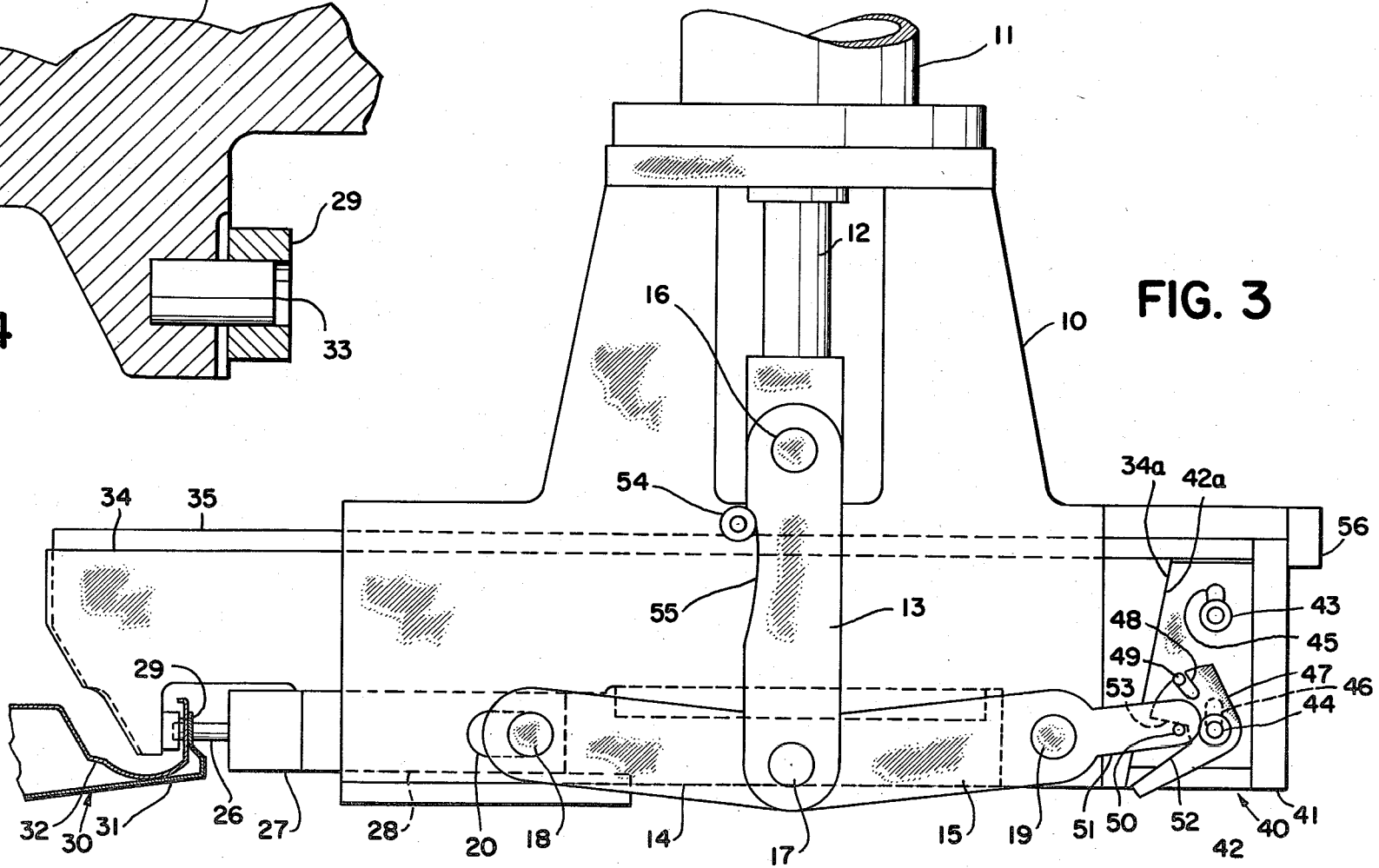
FIG. 3 is a similar view of the machine of FIGS. 1 and 2, but taken between its piercing and flattening positions.
FIG. 4 is a cross-sectional view taken vertically through the center of the extreme left-end portion of the machine jaws when these are in the position shown in FIGS. 1 and 2.

Further downward movement of piston rod 12 will carry the linkage downwardly beyond toggle so that the pin 17 is actually below the position shown in FIG. 2 and the angle defined between jaw link 14 and positioning link 15 is again less than 180° but open upwardly rather than downwardly as shown in FIG. 1. This relationship is illustrated in FIG. 3. As the piston rod 12 then moves back upwardly, the jaw and positioning links 14 and 15 will again pass through a toggle position in which the angle defined between them is 180°. As the piston rod continues further upwardly, they will progressively reassume the position illustrated in FIG. 1.

At the left-hand end of the machine as that machine is illustrated in the drawings, there is a jaw assembly generally designated by the numeral 25. This jaw assembly includes a piercing punch 26 carried by a piercing punch holder 27 which, in turn, is held for horizontal movement by a piercing punch slide 28 which is mounted for horizontal reciprocating movement within main frame 10.

To the left of piercing punch 26, and as particularly visible in the cross-sectional view of FIG. 4, there is a piercing die 29 so dimensioned as to be capable of cooperating with piercing punch 26, when the latter is brought into cooperative relation with the piercing die, in a manner described more fully hereafter to pierce a multi-layer structure in the partial manner required by the type of joint being made. FIGS. 2 and 3 of the drawings show such a structure 30 in the position in which it is operated upon by the machine. This structure may, for example be the perimeter of an automobile hood turned, in this case, upside down from its ultimate intended position for the purpose of being worked upon by this machine. The hood consists of an outer metal surface 31 and an inner liner 32 which may be made of metal or plastic, as desired. The important thing to note about this structure 30 is its complex, re-entrant configuration at the location which is to be used for forming joints between the inner and outer layers.

Within the interior of die 29, there is positioned the swaging or flattening punch 33 (see again particularly FIG. 4). The structure which holds these die and swaging punch 29, 33 combination consists of three slides reciprocable within the frame 10 from right to left and back again in the drawings. The three slides consists of two outer slides 34 between which is sandwiched an inner slide 35. The flattening punch 33 is carried by this inner slide 35 whereas the die is carried by the outer slides 34.

Turning now to the opposite, or right-hand end of the frame 10 of the machine, it will be seen that there is positioned at this right-hand end a mechanism which is collectively designated as positioning assembly 40. This positioning assembly includes an end plate 41 which is fixedly attached and terminates in a slide 35 and which extends at right angles to that slide, i.e., into and out of the plane of the paper in the drawings to a lateral distance wide enough to also encompass the width of the two outer slides 34.

The outer slides 34, themselves, terminate in sloping end surface **34*a*. Between these sloping end surfaces 34*a* and end plate 41, there is positioned a wedge-shaped member 42 whose face 42*a* mates with the sloping end surface 34*a* of the outer slides 34. One such wedge-shaped member 42 is positioned adjoining the sloping end face 34*a* of each outer slide 34**. These wedge-shaped members 42 are held in place but with limited vertical movement permitted, by means of pins 43 and 44 slidable within slots 45 and 46 respectively. Also mounted for pivoting about pin 44 is a three-fingered cam 47. Trapped within slot 48 of this cam is a pin 49 fixedly attached to wedge-shaped member 42. A pin 50 protruding from extension 51 of positioning link 15 is capable of abutting against either surface 52 or surface 53 of three-fingered cam 47. The former position is shown in FIG. 1, the latter in FIGS. 2 and 3.

Finally, attention is invited to guide roller 54 and cam surface 55, the former being fixedly attached to frame 10 and the latter being provided along the edge of drive link 13 which is adjacent to guide roller 54.

In operation, the machine shown in the drawings is initially brought into the position shown in FIG. 1. In this position, the piercing punch 26 has been retracted to the right and the assembly of both inner and outer slides 35, 34 has been moved to the left by a distance equal to the space shown in FIG. 1 between the right-hand edge of stop member 41 and the left-hand edge of the stop member 56 which is firmly attached to frame 10 and absolutely limit the rightward movement of these inner and outer slides 35, 34. It will be apparent that the rightward movement or retracting movement of piercing punch 26 was accomplished by the rightward movement of pin 18 and its entraiment of piercing punch slide 28 in the process as the toggle linkage 13, 14, 15 was being brought into the position illustrated in FIG. 1. Likewise the leftward movement of the inner and outer slides 35, 34 was produced by the movement from right to left of pin 19 under the influence of the same toggle linkage movement.

What this does is to, in effect, open wide the jaw assembly 25 of the machine. This then enables insertion into that jaw assembly, and particularly between die 29 and piercing punch 26, of the structure to be joined such as that shown at 30 in FIGS. 2 and 3. Incidentally, this position of the inner and outer slides 35, 34 of FIG. 1 is indicated again in broken lines in FIG. 2, in order to show most clearly the difference between these two Figures insofar as the positioning of the inner and outer slides is concerned.

Also at this stage in the operation of the machine, the three fingered cam 47 is in the position shown in FIG. 1, by virtue of the fact that pin 50 bearing against surface 52 rotates this cam into that position about pin 44. Such rotary movement in turn is transmitted to wedge 42 through pin 49 trapped within slot 48 and wedge 42 has therefore assumed its lowermost position. It will be recognized that up and down movement of wedge 42 in turn translates into right and left movement of outer slides 34, by virtue of the mating camming surfaces 34*a*, 42*a* at which the wedge 42 and the outer slides 34 meet. Thus the downward-most position of cam 42 shown in FIG. 1 corresponds to the rightmost position of outer slides 34 insofar as the right and left displacement of these outer slides 34 is concerned which is imparted by up and down movement of wedge 42.

It is desired to emphasize that this right-left movement of outer slides 34 is to be carefully distinguished from the right-left movement of both outer slides 34 and inner slides 35, which is accomplished not by up and down movements of wedge 42 but by overall movements of the inner and outer slides assembly simultaneously under the influence of pin 19 carried by positioning link 15. As previously discussed these right-left movements of the entire assembly of inner and outer slides open and close the jaw assembly 25. In contrast, the right-left movements of outer slides 34 only, under the influence of up-down movement of wedge 42 affects only the right-left position of die 29. As will be explained more fully hereafter this position determines whether a piercing or a swaging function is accomplished at any given stage by advance of piercing punch 26.

FIG. 2 shows the same fastening machine at a later stage in its operation than FIG. 1, and specifically with the jaw link 14 and the positioning link 15 in their toggle position, reached as a result of downward movement of drive link 13 from the position illustrated for that drive link in FIG. 1.

One important change which will be discerned in FIG. 2 as compared with FIG. 1 is that the assembly of both inner and outer slides 34, 35 has moved to the right, up against stop member 56. This was the result of rightward movement of pin 19 within slot 21 during straightening of jaw and positioning links 14, 15. Therefore both piercing die 29 and flattening punch 33 have been carried to the right by the same amounts, i.e. they remain in the same relative positions which they occupied in FIG. 1 but further to the right. At the same time, piercing punch 26 has been moved leftward under the influence of pin 18 acting through slot 20 upon slide 28. In fact this has taken place to such an extent that piercing punch 26 has traversed both thicknesses of material 31 and 32 and has displaced these into the interior space within die 29 permitted by the retracted positioning of flattening punch 33 within the die.

Attention is invited to the fact that wedge 42 remains in the same downward-most position as in FIG. 1. Although extension 51 from positioning link 51 has pivoted, and so has pin 50 to the extent that it is no longer bearing upon surface 52 of three fingered cam 47, nevertheless this pivoting has not been of sufficient magnitude to cause the three fingered cam to also rotate. Rather, the pin 50 has at this point (FIG. 2) traversed the space between surfaces 52 and 53, during which it exerts no turning force upon the three fingered cam 47 and, as a result, also no up or down moving force upon wedge 42.

In FIG. 3 the downward movement of drive link 13 has continued carrying the jaw and positioning links 14, 15 beyond their toggle position and into the reverse folded position from that which they had in FIG. 1. This causes no significant movement of piercing punch 26 because, although pin 18 slides rightwardly, there is "play" provided by slot 20, so that this small amount of rightward movement is not transmitted to a significant degree to piercing punch 26. On the other hand, this further downward movement of drive link 13 does cause a change in the situation at the positioning assembly 40. In particular, the extension 51 of positioning link 15 pivots even further up beyond the position shown in FIG. 2 and so does pin 50 protruding from this extension 51. This further upward movement of pin 50 is now transmitted to three fingered cam 47 through bearing of pin 50 upon surface 53. The cam 47 consequently rotates clockwise about pin 44 and this clockwise movement is in turn translated into an upward movement of wedge 42 by pin 49 within slot 48.

The effect of this movement of wedge 42 upwardly is to push outer slides 34 to the left with respect to the position which these occupied in FIG. 2. For clarity, there is shown in FIG. 3 in broken lines the position of the left-most edge of outer slides 34 which these occupied in FIG. 2. This is to be contrasted with the solid line position of this lefthand edge of slides 34 which is shown in FIG. 3. The latter is the position which these outer slides 34 in fact occupy at the stage of operation of the machine represented in FIG. 3.

The consequence of this leftward movement by the distance between the broken and solid line lefthand edges of outer slides 34 in FIG. 3 is to move the die 33 to the left by a corresponding distance but without affecting the position of flattening punch 29 which remains in the same location in which it was in FIG. 2. Thus, in effect, the die 33 is pulled away to the left from the two layers of material 31, 32 which had been pierced in the stage of operation illustrated in FIG. 2.

In addition, however, and this is very important, the construction of the slot arrangement cooperative with pin 19, is such that this small leftward movement of the outer slides 34 has also been transmitted to the entire toggle linkage 13, 14 and 15. This linkage has therefore been displaced to the left and, when the linkage now returns to the toggle position by virtue of upward movement of drive link 13 during the upward movement of the reciprocating piston rod 12, the leftward excursion of piercing punch 26 will be greater than it was during the piercing action.

This is the result of providing not only the slot 21 in main frame 10, but also a shorter slot 21*a* in inner slide 35, while fixing pin 19 with respect to outer slide 34. When the outer slides move leftward because of upward movement of wedge 42, pin 19 moves leftward against the left-hand end of short slot 21*a*, and is maintained in that position during return through toggle of the linkage. The positioning link 15 must therefore pivot about that left-most position pin 19, and the whole linkage, including the punch 26, is carried further to the left, causing the desired swaging action.

The idler 54 serves to restrain the drive link from moving further to the left than desired and cam surface 55 controls these excursions at the various stages of machine operation. This then results in subjecting the materials 31 and 32 to compression between the piercing punch 26 and the swaging punch 33. This differs from what has happened in the prior operation of the piercing punch when the material was subjected to piercing by interaction between piercing punch 26 and die 33 but not to compression between piercing punch 26 and flattening punch 33. With the die 29 retracted to the left away from these layers of material 31, 32 at this stage in the operation of the machine (FIG. 3) the result of this compression is a lateral expansion of the compressed material, thereby locking the joint in place.

It will be appreciated that, by selecting the distance which die 29 moves to the left during the displacement discussed in connection with FIG. 3 above determines how much of the two displaced layers of material 32, 33 becomes subject to lateral spreading. If the leftward displacement of die 33 is only by the thickness of material layer 31, then only one of these displaced layers of material will be able to spread laterally during the compression or swaging action. On the other hand if the leftward displacement is equal to the thickness of both material layers 32 and 31, then both of these layers of material will be subjected to lateral spread. Intermediate displacements will give rise to intermediate spreading conditions.

The extent of such leftward displacement of die 33 is adjustable by appropriately modifying the positioning assembly of the machine. One such possible modification involves the slope of the edges 34*a*, 42*a*. As this slope is made steeper relative to the horizontal, the distance of displacement of the outer slides 34 and with it the distance of leftward displacement of die 29 decreases. However this would require a rather extensive modification of the machine involving removal of the outer slides and removal of wedge 42 and replacement of both with corresponding elements having their mating surfaces 34*a* and 42*a* and a different angle. A much easier way of achieving such adjustment is by the extent of vertical displacement of the wedge shaped element 42. This can be adjusted readily by simply slipping three fingered cam 47 off its mounting shaft 44 and replacing it with a three fingered cam in which the angular spacing between edges 52 and 53 is different. The smaller this angular spacing the greater will be the displacement of wedge shaped cam 42 resulting from the operation of the machine. Conversely the wider this angular spacing the less will be this vertical displacing. A lesser vertical displacement of wedge shaped cam 42 produces a smaller leftward displacement of die 29 and conversely a greater vertical displacement of wedge shaped cam 42 produces a greater leftward displacement of die 29.

A still easier method of adjustment is by control of the extent of downward (reverse folded) movement of links 14 and 15 (see FIG. 3). The further these links are moved downward beyond the toggle condition, the further extension 51 will move upwardly, and the more cam 47 will rotate. This, in turn, will move wedge 42 upward further, and cause greater leftward displacement of outer slides 34 bearing die 29. The converse is true for lesser downward displacement of links 14, 15. Thus, control of the downward excursion of piston rod 12 effects the desired control of die movement, within the limits of vertical movement of wedge 42.

Having now completed the piercing and swaging operation of the materials 31 and 32, thereby forming the desired joint in the edge of assembly 30, the upward movement of drive link 13 continues until that link finally ends up back in the position of FIG. 1. This results in repositioning the jaw assembly 25 in the position illustrated in FIG. 1. This involves piercing punch 26 being retracted to the right, while inner and outer slides 35 and 34 are being extended to the left but in such relative alignment that die 29 again protrudes sufficiently to the right beyond flattening punch 33 to permit piercing by piercing punch 26 in a subsequent operating cycle of the machine.

Many variations in the machine embodying the invention will occur to those skilled in the art, without departing from the inventive concept.

For example, the specific shape of jaw assembly 25 can, of course, be varied to suit the particular hard-to-reach configuration to be worked upon.

If more than one point is to be made in close proximity, the machine can be widened and two or more punch-and-die elements positioned side-by-side, all actuated by the same mechanism.

The machine itself can be fixed, or "portable," e.g. suspended from a chain hoist for convenient movement to the work location, and so forth.

Variations are also possible in the camming arrangements of positioning assembly 40.

I claim:

1. A machine for producing locking joints in hard-to-reach locations which require not only joint-producing relative movements between a piercing punch, die and flattening punch which constitute the tool elements of the machine, but which also require additional movements of at least some of these tool elements to position them operatively relative to the locations at which the joints are to be formed, said machine comprising a main machine frame which remains stationary during both the joint-producing movements and the additional movements, a plurality of means for holding the three different tool elements, each of said holding means being reciprocably mounted on the stationary frame, positioning means also mounted on the frame and including means movable to reciprocably change the relative positions between the tool element holding means, and toggle linkage means also mounted on the frame and adapted to be reciprocably actuated to go through toggle alternately in opposite directions, a first link of the linkage means imparting the joint-producing reciprocating movement to one of the tool element holding means, and a second link of the linkage means imparting the joint-producing and additional movements to the other tool element holding means, including the movements for changing the relative positions between tool element holding means.

2. The machine of claim 1 wherein the tool element holding means include a plurality of different slides for moving the different tool elements, the slides being reciprocable along paths parallel to each other.

3. The machine of claim 2 wherein the positioning means includes cam means reciprocable at right angles to the slides and having a plane surface portion inclined with respect to the reciprocating path of the cam means, the inclined surface mating with a correspondingly inclined surface on the slide which moves the die, whereby reciprocating movement of the cam means is capable of producing reciprocating movement of the die.

4. The machine of claim 3 wherein the positioning means further comprises a pivotable, multi-fingered cam, and means coupling the pivotable cam to the reciprocable cam means so that pivoting of the cam in opposite directions can produce reciprocation of the cam means in opposite directions.

5. The machine of claim 4 wherein the positioning means comprises a pin which is displaceable to alternately bear against confronting edges of adjacent fingers of the pivotable cam, whereby to impart rotation to the pivotable cam in one direction when bearing upon one finger edge and in the opposite direction when bearing on the confronting finger edge.

6. The machine of claim 5 wherein the pin is mounted for displacement by the second toggle link.

7. The machine of claim 2 comprising means responsive to predetermined movements of the second toggle link to reciprocate by the same distance along said parallel paths the slides moving both the die and the flattening punch.

8. The machine of claim 7 comprising means responsive to movements of the second toggle link different from said predetermined movements to reciprocate the slide for moving the die without reciprocating the slide for moving the flattening punch.

9. The machine of claim 8 wherein the toggle linkage includes a drive link for causing the linkage to reciprocate, the drive link being movable substantially at right angles to the first and second links when these are in their toggled condition.

10. The machine of claim 9 comprising means for producing reciprocating movement of the drive link, including a hydraulic piston mounted on the main frame, and a piston rod connected to the drive link.

11. The machine of claim 10 wherein a complete set of movements of the tool elements is carried out during a single reciprocating stroke of the piston rod.

12. The machine of claim 1 wherein the tool holding means are so configured that the die and flattening punch are capable of penetrating into a re-entrant shape defined by the materials to be joined.

* * * * *